United States Patent [19]

Becker et al.

[11] Patent Number: 4,467,774

[45] Date of Patent: Aug. 28, 1984

[54] APPARATUS FOR RECIRCULATING THE EXHAUST GAS OF AN INTERNAL COMBUSTION ENGINE

[75] Inventors: Wolfram Becker; Hermann Klein, both of Eberdingen, Fed. Rep. of Germany

[73] Assignee: Robert Bosch GmbH, Stuttgart, Fed. Rep. of Germany

[21] Appl. No.: 532,136

[22] Filed: Sep. 14, 1983

[30] Foreign Application Priority Data

Sep. 24, 1982 [DE] Fed. Rep. of Germany ..... 3235397

[51] Int. Cl.[3] ..... F02M 25/06; F02D 23/00

[52] U.S. Cl. ..... 123/568; 60/316; 60/319; 123/570

[58] Field of Search ..... 123/568, 570; 60/316, 60/319; 123/569, 571

[56] References Cited

U.S. PATENT DOCUMENTS

| | | | |
|---|---|---|---|
| 1,635,938 | 7/1927 | Hudson | 60/316 |
| 3,782,348 | 1/1974 | Linder | 123/571 |
| 3,799,133 | 3/1974 | Frank | 123/571 |
| 4,333,440 | 6/1982 | Eheim | 123/569 |
| 4,399,798 | 8/1983 | Stoutman | 123/571 |
| 4,418,532 | 12/1983 | Momose et al. | 60/316 |

*Primary Examiner*—Wendell E. Burns

*Attorney, Agent, or Firm*—Edwin E. Greigg

[57] ABSTRACT

For recirculating the exhaust gas of an internal combustion engine, a recirculation line is provided which leads from the exhaust side to the intake side of the engine. A valve for controlling the recirculation rate is disposed in the line, and in order to prevent the formation of condensates in the line on the exhaust side when the valve is closed, a flushing line is provided which leads from the line segment on the exhaust side to a location point having lower pressure as compared with the exhaust side.

3 Claims, 1 Drawing Figure

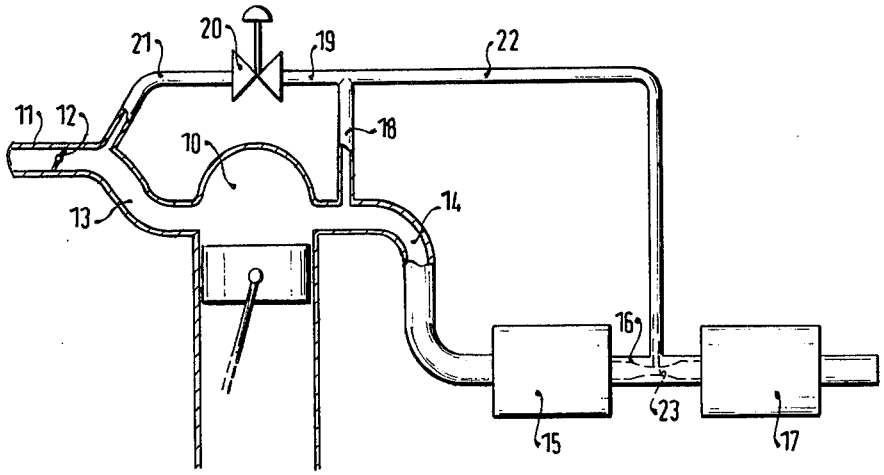
20
21
19
22
11
12
10
18
13
14
16
23
15
17

APPARATUS FOR RECIRCULATING THE EXHAUST GAS OF AN INTERNAL COMBUSTION ENGINE

BACKGROUND OF THE INVENTION

The invention is based on an apparatus for recirculating the exhaust gas of an internal combustion engine, having a line leading from the exhaust to the intake side of the engine and a valve for controlling the rate of recirculation disposed in the line.

In order to improve the exhaust gas quality, it is known to provide engines with exhaust gas recirculation systems, in which a bypass line leads from the exhaust to the intake side of the engine. A valve is provided in the bypass line and is triggered in accordance with prespecified criteria in order to adjust the recirculation rate. An apparatus of this general type is known, for instance, from German Offenlegungsschrift No. 29 09 465, corresponding to U.S. Pat. No. 4,333,440.

In the case of cylinder heads with side-by-side valves, the exhaust gas recirculation line is as a rule quite short because of the structural arrangement; in engines with a crosswise cylinder head with opposing valves, however, because of the structural arrangement a relatively long line is required to reach from the exhaust side to the intake side of the cylinder head. If the recirculation rate is set relatively low, for instance during full-load operation, the valve in the exhaust gas recirculation line is closed. As a result, cooling of the exhaust gas then occurs in the recirculation line, causing the formation of condensates. If the recirculation rate is then increased again, the condensate collected in the recirculation line reaches the intake tract of the engine and, together with the cooled exhaust gas component of the clearance volume of the recirculation line, results in indefinite operation of the engine during this transition. However, since engine regulation is based on hot exhaust gas, the consequence is incorrect control of the engine, which in turn makes vehicle operation less smooth and can in fact negate any improvement in the exhaust gas quality that may be attempted by means of exhaust gas recirculation.

OBJECT AND SUMMARY OF THE INVENTION

The apparatus according to the invention has the advantage over the prior art in that condensate formation is avoided, that the corrosion in the recirculation line is thereby reduced, and finally that the is thereby reduced, and finally that the transitional behavior of the engine when the recirculation rate is changed is improved, thereby improving the quality of the exhaust gas.

In a preferred embodiment of the invention, the negative pressure required for flushing the exhaust gas recirculation line is generated with existing means by connecting the recirculation line to the junction of a pre-muffler and a post-muffler, a point which has a lower pressure than does the exhaust side of the engine. In a further development of the invention, the flushing operation is improved by providing a Venturi tube disposed in this pipe segment between the pre-muffler and the post-muffler.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing illustrates the fundamental layout of one form of embodiment of the apparatus according to the invention.

DESCRIPTION OF THE PREFERRED EMBODIMENT

In FIG. 1, 10 identifies the cylinder head of an internal combustion engine, the intake side of which comprises an intake tube 11 having a throttle valve 12 and an intake manifold 13. The exhaust side of the engine, in corresponding fashion, comprises an exhaust manifold 14, which leads to a pre-muffler 15, a tube 16 and a post-muffler 17. The exhaust side of the cylinder head 10 is connected with the intake side via a line, which comprises a first line 18 which is connected directly to the exhaust gas outlet from the cylinder head 10 and then merges with a second line 19. The second line 19 leads to an exhaust gas recirculation valve 20, from which a third line 21 leads to the intake manifold 13. It will be understood that this deposition of the lines is intended only by way of example, and that it may also be structured differently within the competence of one skilled in the art; for instance, the exhaust gas recirculation valve 20 could be disposed directly in or at the intake manifold 13. From the junction of the first line 18 and the second line 19, a flushing line 22 leads in accordance with the invention to the muffler stage comprising the connecting tube 16 between the pre-muffler 15 and the post-muffler 17. The pressure prevailing in the tube 16 is lower than that at the location where the first line 18 discharges into the exhaust manifold 14. The quantity of exhaust gas delivered to the exhaust gas recirculation valve 20 is larger, because of the corresponding dimensioning of the lines 18, 19, than is required for the actual recirculation process. The excess portion of the exhaust gas now flows back via the flushing line 22 to the exhaust side. This is particularly true whenever the exhaust gas recirculation valve 20 is closed, so that the total throughput of the first line 18 then flows into the flushing line 22. Now, if the second line 19 is embodied as very short in structure, the flushing line 22 assures that there will always be virtually complete flushing through the portion of the recirculation line on the exhaust side. In principle, it would actually be possible to exhaust the flushing line 22 directly into the atmosphere, because even then the necessary pressure ratios would be assured; but this would cause problems with noise, because the exhaust gas flowing out of the flushing line would not be muffled. For this reason, the form of embodiment shown in the drawing is particularly advantageous, because the post-muffler 17 assures sufficient muffling of sound. Since the flushing line 22 also has a smaller cross section than the normal exhaust line, the damping effect of the post-muffler 17 is sufficient.

If with appropriate dimensioning of the exhaust system the pressure difference between the exhaust manifold 14 and the tube 16 is too small, then in a further provision of the invention the tube 16 may be provided with a Venturi tube 23, so that the negative pressure in the tube 16 which is required for the flushing operation will be assured.

The foregoing relates to a preferred exemplary embodiment of the invention, it being understood that other variants and embodiments are possible within the spirit and scope of the invention, the latter being defined by the appended claims.

What is claimed and desired to be secured by Letters Patent of the United States is:

1. An apparatus for recirculating the exhaust gas of an internal combustion engine having a line segment leading from the exhaust side to the intake side of the engine in which a valve for controlling the recirculation rate is disposed, the improvement comprising a flushing line connecting a pair of said line segment leading from the exhaust gas side to said valve, to a location point having lower pressure than the pressure in said exhaust side.

2. An apparatus as defined by claim 1, wherein said location point comprises connecting tube disposed between a pre-muffler and a post-muffler in an exhaust gas line.

3. An apparatus as defined by claim 2, wherein said connecting tube is embodied as a Venturi tube at said location point.

* * * * *